US006443708B1

(12) United States Patent
Hirota

(10) Patent No.: US 6,443,708 B1
(45) Date of Patent: Sep. 3, 2002

(54) COMPRESSION VOLUME CONTROL APPARATUS FOR REFRIGERATION CYCLE

(75) Inventor: Hisatoshi Hirota, Hachioji (JP)

(73) Assignee: TGK Co., Ltd., Tokyo (JP)

( * ) Notice: Subject to any disclaimer, the term of this patent is extended or adjusted under 35 U.S.C. 154(b) by 0 days.

(21) Appl. No.: 09/707,216

(22) Filed: Nov. 3, 2000

(30) Foreign Application Priority Data

Nov. 5, 1999 (JP) ..... 11-314575

(51) Int. Cl.[7] ..... F04B 1/26
(52) U.S. Cl. ..... 417/222.2
(58) Field of Search ..... 417/222.2

(56) References Cited

U.S. PATENT DOCUMENTS 5,702,235 A * 12/1997 Hirota et al. ..... 417/222.2
6,062,823 A * 5/2000 Kawaguchi et al. ..... 417/222.2
6,102,668 A * 8/2000 Kawaguchi et al. ..... 417/222.2
6,162,026 A * 12/2000 Kimura et al. ..... 417/222.2
6,241,483 B1 * 6/2001 Kato et al. ..... 417/222.2
6,267,562 B1 * 7/2001 Hirota ..... 417/222.2
6,302,656 B1 * 10/2001 Hirota ..... 417/222.2

* cited by examiner

*Primary Examiner*—Charles G. Freay
*Assistant Examiner*—Michael K. Gray
(74) *Attorney, Agent, or Firm*—Niles & Niles SC

(57) ABSTRACT

An electromagnetic control valve of a fast response compression volume control apparatus for a refrigeration cycle is provided which connects and blocks a pressure adjusting chamber of the compressor to and from a discharge chamber or a suction chamber such that the a differential pressure between at least one of a pressure in the pressure adjusting chamber and a pressure in the suction chamber and a pressure in the discharge chamber is maintained at a predetermined differential pressure value. The differential pressure is changed by changing the electromagnetic force of the electromagnetic control valve such that the discharge volume of the refrigerant is controlled and the compression volume becomes a predetermined one in a prompt action without a time delay when the electromagnetic force is varied.

14 Claims, 6 Drawing Sheets

COMPRESSION VOLUME CONTROL APPARATUS FOR REFRIGERATION CYCLE

BACKGROUND OF THE INVENTION

1. Field of the Invention

The present invention relates to a compression volume control apparatus for a refrigeration cycle particularly for use in an air-conditioning system of a vehicle, including a variable displacement refrigerant compressor having a suction chamber connected to a low-pressure refrigerant pipe and a refrigerant discharge chamber connected to a high-pressure refrigerant pipe (2), a refrigerant discharge volume being variable by varying the pressure in a pressure adjusting chamber of said compressor.

As the compressor used in a refrigeration cycle of a vehicular air-conditioning system directly is coupled to the engine by a belt, the speed of the compressor cannot be controlled independently. In order to achieve an adequate cooling performance without a restriction by the momentary engine speed, it is conventional to use a variable displacement compressor, the compression volume or discharge volume of which can be altered.

Different types of variable displacement compressors can be used like the so-called swash plate type, the rotary type and the scroll type. By way of an example the swash plate type compressor will be explained here. It operates with reciprocating pistons by rotating a driving oscillating plate provided in the crank chamber. The stroke of the pistons is varied by varying the inclination angle of said plate with respect to a driving shaft.

In a swash plate compressor for variable displacement the crank chamber defines a pressure adjusting chamber to vary the displacement of the compressor for compression volume control. The crank chamber pressure conventionally is controlled in association with a change of a suction pressure in order to vary the volume.

When controlling the volume based on the suction pressure, however, a flexible film member like a diaphragm or bellows responding to pressure variations is used which is placed in a moveable manner in the compression volume control apparatus. For that reason the apparatus has to be designed large and the costs for the apparatus are high.

2. Discussion of the Related Art

Another volume control apparatus as known from Japanese Laid-Open patent publication No. Hei 5-87047 is provided with an electromagnetic control valve for interconnecting or separating the crank chamber defining the pressure adjusting chamber and the suction chamber to maintain a differential pressure between the crank chamber pressure and the suction pressure at a predetermined value, e.g. as selected by the adjusted electromagnetic force and by spring forces. The electromagnetic force of the electromagnetic control valve is changed to change the value of said differential pressure as well. The structure of said control valve is simple and compact. The apparatus costs are fair.

FIG. 6 is a line chart showing the "Enthalpy versus Refrigerant Pressure" characteristics of a refrigeration cycle. The displacement of the compressor is controlled on the basis of a differential pressure Pc−Ps between the crank chamber pressure Pc and the suction pressure Ps. The discharge pressure Pd is then changed accordingly which automatically leads to further change of the differential pressure Pc−Ps. Said control routine is repeated under feedback control via the entire refrigeration cycle as a system. Said control routine has a shortcoming because a time delay occurs for the discharge volume to reach a predetermined value when the electromagnetic force of the electromagnetic control valve is changed. The result is that the compression volume control cannot be carried out promptly enough.

OBJECT AND SUMMARY OF THE DRAWINGS

It is an object of the present invention to provide a fast responding compression volume control apparatus for a refrigerating cycle which allows to achieve a predetermined compression volume promptly and without a time delay as soon as the electromagnetic force of the electromagnetic control valve is changed.

Said electromagnetic control valve connects or separates said pressure adjusting chamber from said discharge chamber or the suction chamber in order to maintain the differential pressure between at least one of the pressure in the pressure adjusting chamber and the pressure in the suction chamber at one side and the pressure in the discharge chamber at the other side at a predetermined differential pressure value. Said differential pressure value is changed by changing the electromagnetic force of the electromagnetic control valve in order to control the discharge volume of the refrigerant. The control routine is executed on the basis of the level of the discharge pressure Pd itself which in turn is changed by volume control and feedback control only carried out by the compressor portion. As soon as the electromagnetic force of the electromagnetic control valve is changed the compression volume promptly reaches a predetermined value without a time delay. This ensures a fast response compression volume control.

In a first preferred embodiment said electromagnetic control valve exclusively is establishing a connection or separation between the discharge chamber and the pressure adjusting chamber, the pressures in said discharge chamber and said pressure adjusting chambers both are acting counter to said electromagnetic force loading said valve body in closing direction. For decreasing said pressure in said pressure adjusting chamber a leakage passage is provided between said pressure adjusting chamber and said low-pressure suction pipe.

In another preferred embodiment the pressure in said discharge chamber is loading said valve body in opening direction and counter to the electromagnetic force, while said suction chamber pressure is loading said valve body in closing direction. Said pressure in said pressure adjusting chamber has no influence on the loading of the valve body in either direction. The necessary leakage path, e.g. between said suction chamber and said pressure adjusting chamber, can be provided inside said electromagnetic control valve.

In another preferred embodiment the pressure in said discharge chamber is loading said valve body in the same direction as said electromagnetic force and counter to the pressure in said pressure adjusting chamber, while the pressure in said suction chamber does not have any influence on the motion of said valve body.

In another preferred embodiment the pressure in said discharge chamber is loading said valve body in closing direction and in parallel with said electromagnetic force, while said pressure in said pressure suction chamber is loading said valve body in opening direction and counter to said electromagnetic force. The pressure in said pressure adjusting chamber has no influence on the motions of said valve body.

In a further preferred embodiment a valve moveable between an open and closed position is provided in the low-pressure suction line upstream of said suction chamber. Said valve is pilot operated by an auxiliary valve situated within said electromagnetic control valve. Said pilot valve is actuated by said electromagnetic control valve in order to open and close said valve in said low-pressure pipe.

BRIEF DESCRIPTION OF THE DRAWINGS

Embodiments of the invention will be explained with the help of the drawings. In drawings is.

DESCRIPTION OF THE PREFERRED EMBODIMENTS

Figure 1:
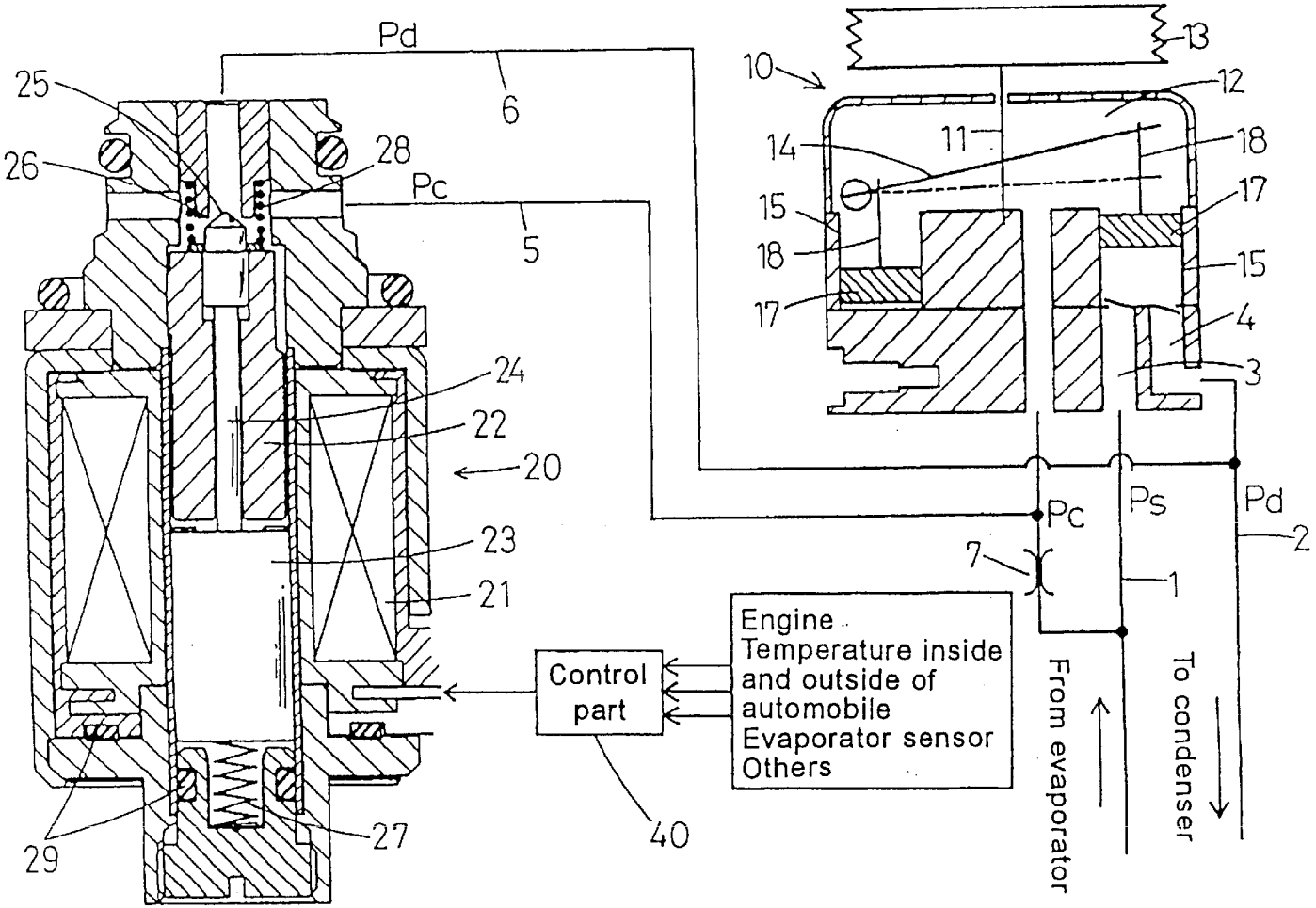
FIG. 1 cross-sectional views in a block diagram of a general structure of a compression volume control apparatus for a refrigeration cycle (first embodiment), FIG. 2 an axial cross-sectional view of a volume control valve (second embodiment), FIG. 3 an axial cross-sectional view of a volume control valve (third embodiment), FIG. 4 an axial ross-sectional view of a volume control valve (fourth embodiment ), FIG. 5 an axial cross-sectional view of a volume control valve (fifth embodiment), and FIG. 6 an characteristic line chart of a refrigeration cycle.

A swash plate type variable displacement compressor 10 in an air-conditioning refrigeration cycle of an automobile is shown in FIG. 1, operating with ordinary R134A refrigerant or the like. However, the invention also can be used for a carbon dioxide refrigeration cycle. In an airtight crank chamber defining a pressure adjusting chamber 12 of said compressor a rotary shaft 11 is placed. Shaft 11 is driven by a pulley 13. In crank chamber or pressure adjusting chamber 12 on shaft 11 an oscillating plate 14 is provided inclined in relation to shaft 11 and rocking in accordance with the rotation of shaft 11. Cylinders 15 arranged in a peripheral portion of crank chamber 12 and receive pistons 17 which are coupled to said rocking oscillating plate 14 by rods 18.

As soon as oscillating plate 14 is rocking the pistons 17 reciprocate in cylinders 15. Low-pressure refrigerant (suction pressure Ps) is sucked into cylinders 15 from a suction chamber 3. Said refrigerant is compressed in cylinders and is discharged under discharge pressure Pd into a discharge chamber 4. The refrigerant reaches suction chamber 3 via suction pipe 1 from an evaporator (not shown) situated upstream of suction chamber 3. High pressure refrigerant is fed via a discharge pipe 2 towards a condenser (not shown) located downstream of discharge chamber 4.

The respective inclination angle of oscillating plate 14 in relation to shaft 11 can be varied by a pressure Pc in crank chamber 12. By varying the inclination angle of rocking plate 14 the refrigerant discharge volume or the refrigerant compression volume of cylinders 15 can be varied. Said crank chamber pressure Pc is automatically controlled by an electromagnetic control valve 20 which is an electromagnetic solenoid control type. Said controlling takes place in order to execute compression volume control. In said control valve 20 an electromagnetic coil 21 and a fixed iron core 22 are provided. A valve body 25 and a moveable iron core 23 are coupled by an axially moveable rod 24 passing through fixed iron core 22. Both components are urged from both ends by compression coil springs 27 and 28. Sealing 0-rings 29 are provided for sealing purposes.

Between a crank chamber passage 5 in the body of said control valve 20 and a discharge chamber passage 6 also provided in the body of said control valve 20 a valve seat 26 is formed. Passage 5 is connected to crank chamber 12. Passage is connected to discharge chamber 4. Said valve body 25 is facing valve seat 26 from the side of passage 5. Passage 5 and suction pipe 1 are connected via a thin leakage path 7, e.g. provided in control valve 20 itself, or, as shown, via a bypass line containing a small aperture.

Valve body 25 is loaded in opening direction away from valve seat 26 by a differential pressure Pd−Pc. The electromagnetic force created by feeding current to electromagnetic coil 21 and the attraction of moveable iron core 23 of said volume control valve 20 (including the urging forces of compression coil springs 27 and 28) loads valve body 25 in closing direction towards valve seat 26).

As soon as the value of current supplied to electromagnetic coil 21 is constant, said electromagnetic force will be constant as well. Valve body 25 will carry out opening and closing motions in accordance with a variation of differential pressure Pd−Pc in order to maintain said differential pressure Pd−Pc at least substantially constant. This causes that crank chamber pressure Pc is controlled to a value corresponding to the discharge pressure Pd such that the compression volume (discharge volume) is kept constant. By changing the value of the current feed to electromagnetic coil 21 said electromagnetic force of volume control valve 20 is changed. The differential pressure Pd−Pc which is to be maintained constant also varies accordingly such that the compression volume (discharge volume) again is maintained constant but at a different level determined by said current.

If the electromagnetic force decreases, the differential pressure Pd−Pc which is to be kept constant also is decreasing. This causes that crank chamber pressure Pc will rise to approach the value of said discharge pressure Pd. This reduces the discharge volume of the compressor. If the electromagnetic force increases the differential pressure Pd−Pc which is to be kept constant, also increases. As a consequence, crank chamber Pc decreases in a direction to more strongly differ from discharge pressure Pd. Said action increases the discharge volume.

Since said compression volume control is executed on the basis of said differential pressure Pd−Pc and is also based on the level of the discharge pressure Pd itself which in turn directly varies due to said volume control. Feedback control is carried out exclusively by the compressor 10. This means that with a variation of the value of the current supplied to electromagnetic coil 21, no time delay occurs for the discharge volume to reach a predetermined value. This ensures prompt compression volume control.

The value of the current supplied to electromagnetic coil 21 is controlled by means of detection signals from an engine sensor, sensors for temperatures inside and outside a vehicle's cabin, an evaporator sensor and a plurality of sensors which detect other various conditions. Said detection signals are input into a control section 40 incorporating a CPU or the like. A control signal based on the results of the processing of said detection signals then is supplied to the electromagnetic coil 21 from control section 40 as the operating current. A drive circuit as usually provided for an electromagnetic coil 21 is not shown.

Figure 2:
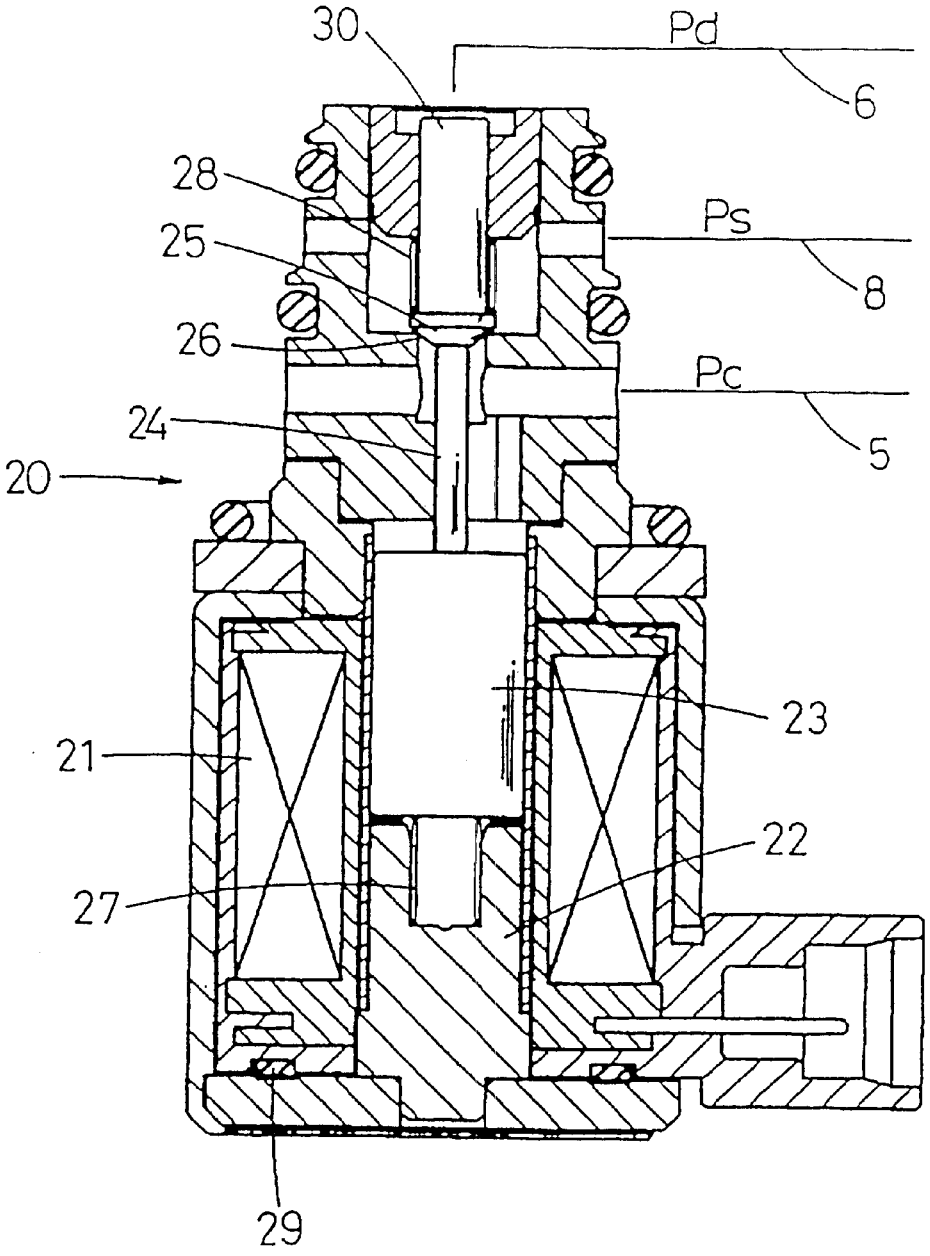

The volume control valve 20 of FIG. 2 (second embodiment) is provided with the fixed iron core 22 and the moveable iron core 23 in inversed positions as in FIG. 1. The positional relationship between valve body 25 and valve seat 26 is reversed accordingly.

In this embodiment an increase or decrease of the differential pressure Pd−Pc which is to be controlled constant in association with an increase or decrease in the current supplied to electromagnetic coil 21 is reversed in comparison to the operation mode of the first embodiment.

In this embodiment discharge chamber passage 6 is connected to a space that faces the rear pressure receiving side of a piston rod 30 formed integrally with valve body 25 at its rear side. Suction chamber passage 8 connected to suction pipe 1, leads to a space facing the side surface of said piston rod 30 only. Piston rod 30 slidably crosses a separation wall between passages 6 and 8. Crank chamber passage 5 leads to a space at the back of valve seat 26 seen from valve body 25. The diameter of piston rod 30 is the same as the diameter of valve seat 26 such that their respective pressure receiving areas are equal. The influence of suction pressure Ps on piston rod 30 and valve body 25 is pressure balanced or cancelled. Only the differential pressure Pd−Pc is acting on valve body 25. Motions of valve body 25 in relation to valve seat 26 connect and block crank passage chamber 5 to and from suction chamber passage 8. As soon as valve body 25 has reached an open position away from valve seat 26, crank chamber passage 25 and suction chamber passage 8 are interconnected. This leads to a reduction of crank chamber pressure Pc.

With the value of the current supplied to electromagnetic coil 21 maintained constant the electromagnetic force of volume control valve 20 is constant as well. Valve body 25 carries out opening and closing motions in accordance with changes of the differential pressure Pd−Pc in order to maintain the differential pressure Pd−Pc constant. In accordance therewith crank chamber pressure Pc is controlled to a value corresponding to the discharge pressure Pd such that the compression volume (discharge volume) is kept constant. By changing the value of the current supplied to electromagnetic coil 21 the electromagnetic force of volume control valve 20 is altered. Then the differential pressure Pd−Pc which is to be kept constant, is varying accordingly. This causes the compression volume (discharge volume) to change in order to be kept constant.

Figure 3:
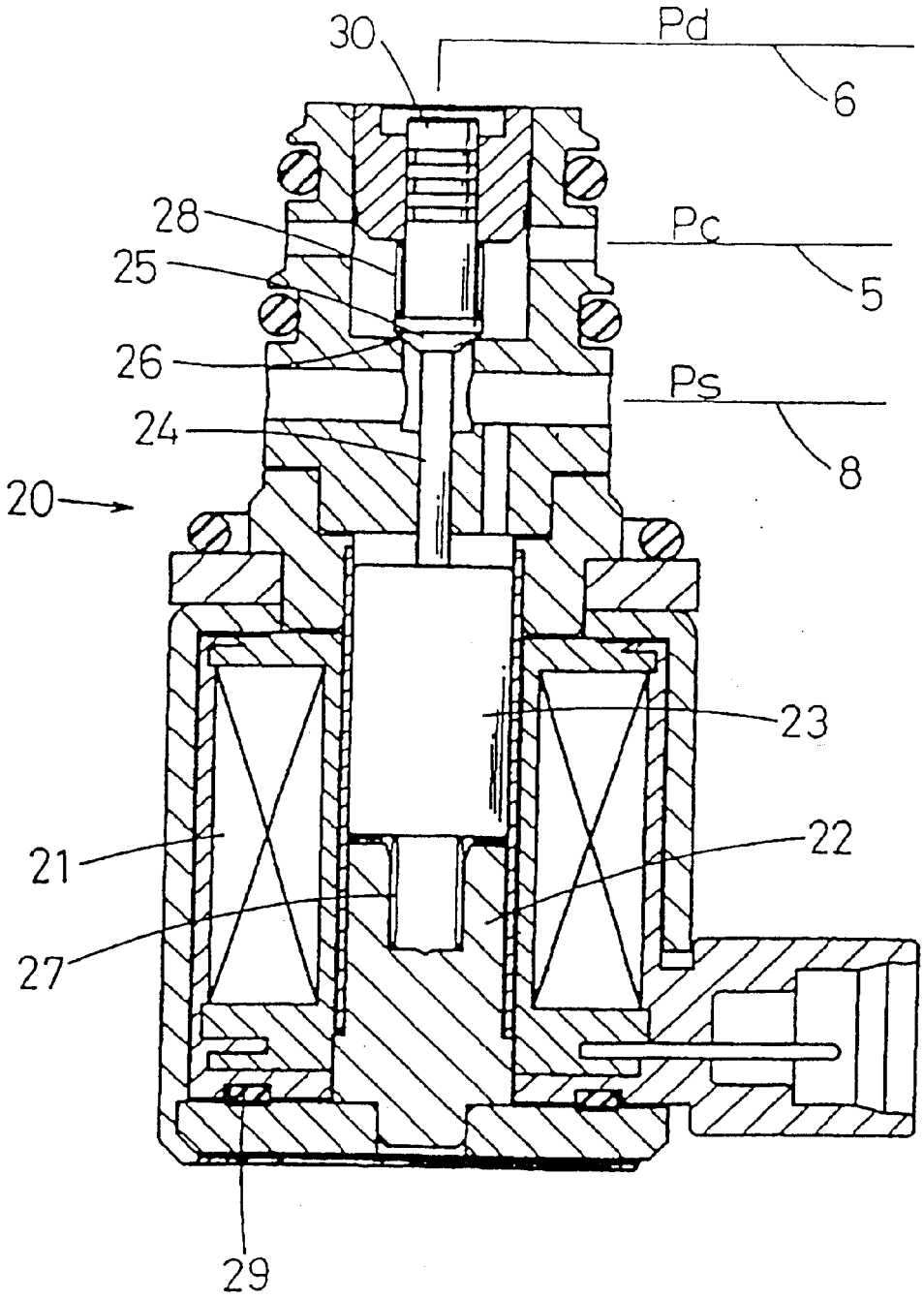

In the third embodiment (FIG. 3) in volume control valve 20 the connection of crank chamber passage 5 and suction chamber passage 8 is reversed in comparison to the second embodiment. Piston rod 30 crosses a separation wall between passages 6 and 5. Valve body 25 is opened or closed by responding to a change in the differential pressure Pd−Ps. As soon as valve body 25 has reached an open position in relation to valve seat 26, crank chamber pressure Pc starts to decrease in order to maintain said differential pressure Pd−Ps constant. If the value of the current supplied to electromagnetic coil 21 is changed, then differential pressure Pd−Ps which is to kept constant, is varying accordingly. This causes the compression volume (discharge volume) to change in order to be maintained constant.

Even if volume control is executed on the basis of differential pressure Pd−Ps said control is based on the level of discharge pressure Pd which in turn itself is directly varied by volume control. Feedback control exclusively is carried out by the compressor portion 10 alone. Therefore, prompt compression volume control is executed.

Figure 4:
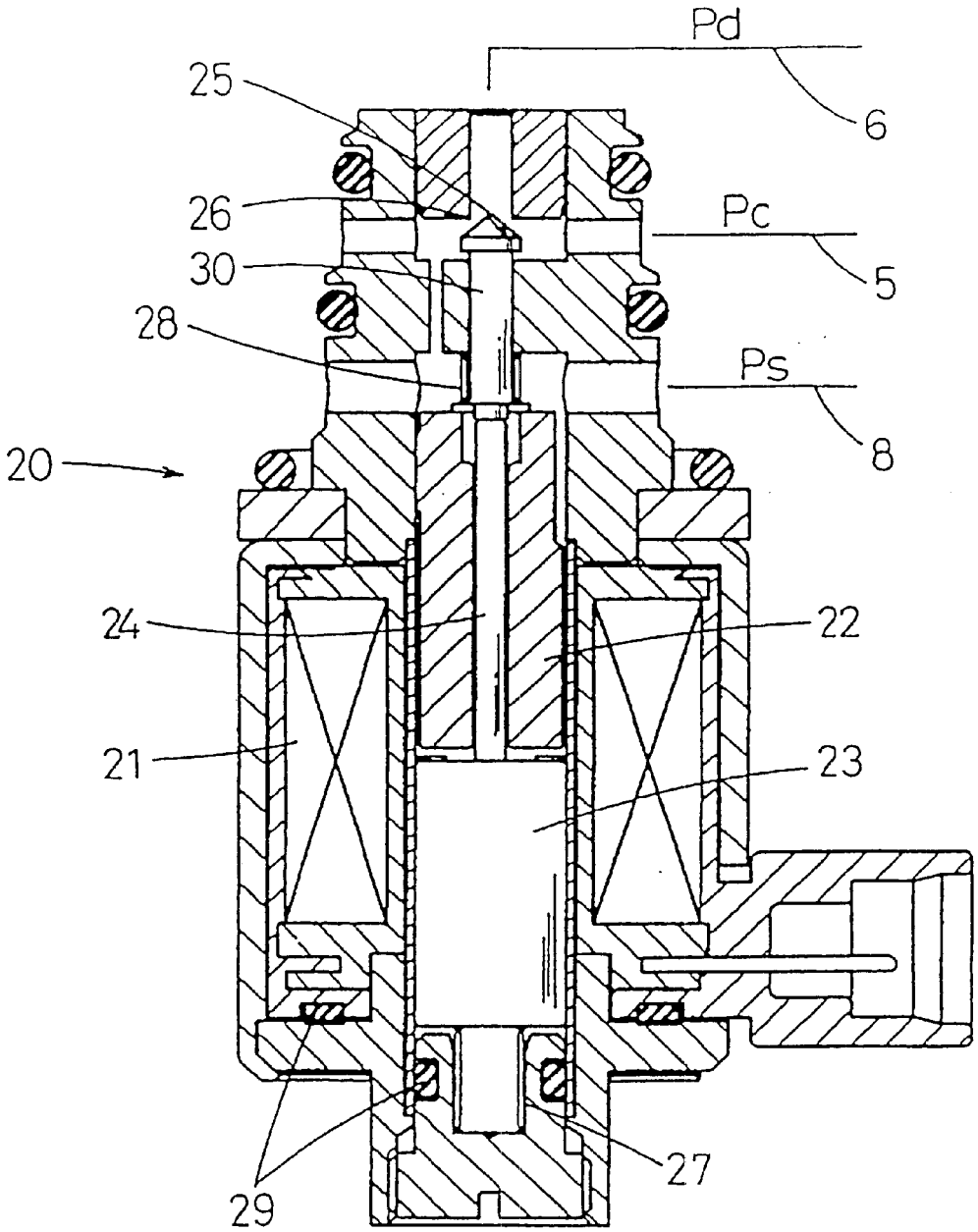

In the fourth embodiment of FIG. 4 the positional relationship between the fixed iron core 22 and the moveable iron core 23 and between valve body 25 and valve seat 26 are like the first embodiment.

Further, at the rear side of valve body 25 piston rod 30 is integrally provided. Piston rod 30 slidably crosses a separation wall between passages 5 and 8. The pressure receiving area of said piston rod 30 is equal to the pressure receiving area of valve seat 26. Suction chamber passage 8 is connected to a space facing the rear pressure receiving side of piston rod 30. Crank chamber passage 5 is connected to a space facing the side surface of piston rod 30 only. Discharge chamber passage 6 is connected to a space at the rear of valve seat 26 seen from valve body 25.

Crank chamber pressure Pc is cancelled in its axial action on piston rod 30 and valve body 25. Valve body 25 carries out opening and closing motions only in response to differential pressure Pd−Ps and controls the connection between crank chamber 12 and discharge chamber 4 to execute compression volume control.

Figure 5:
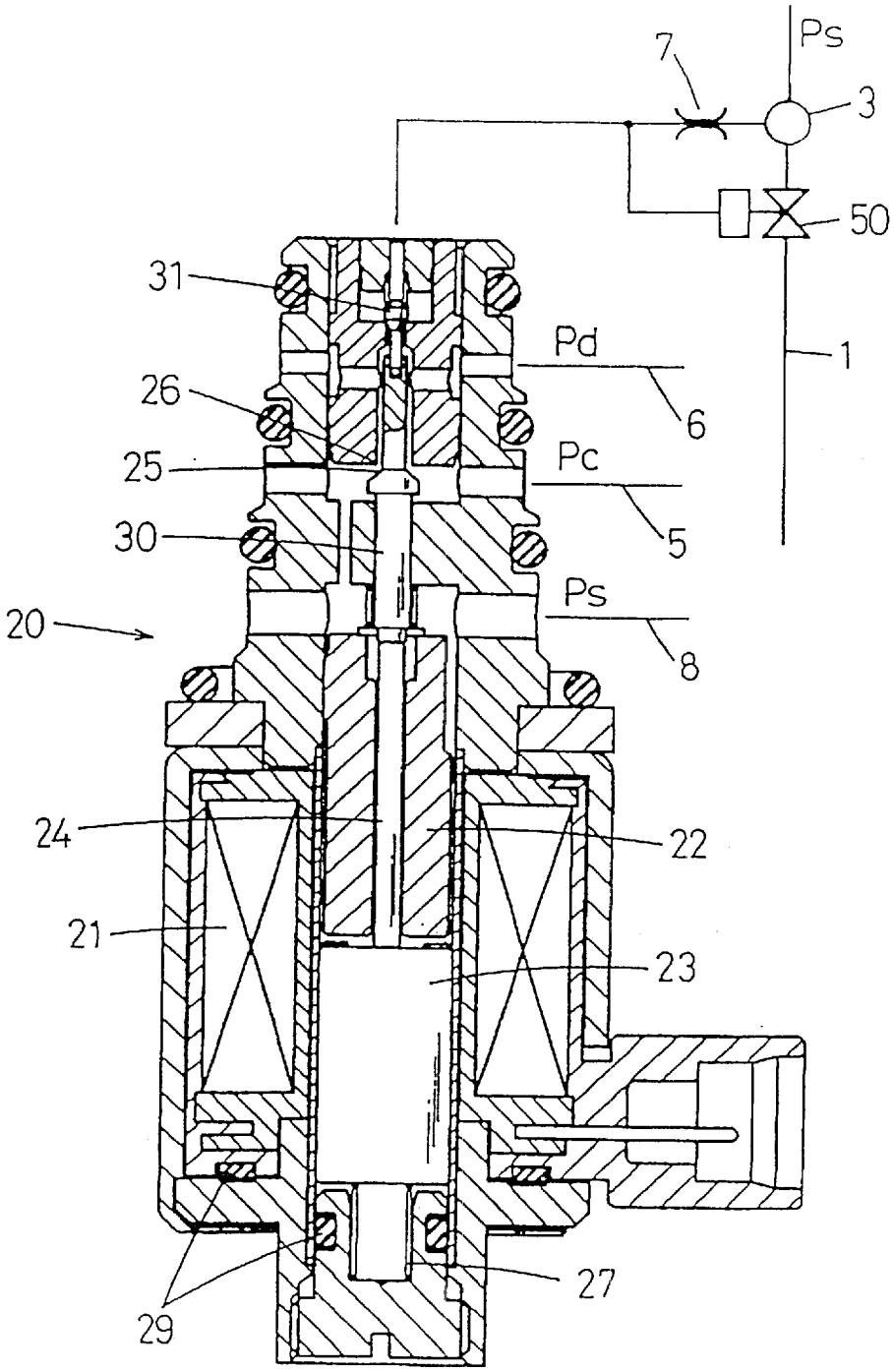
Figure 6:
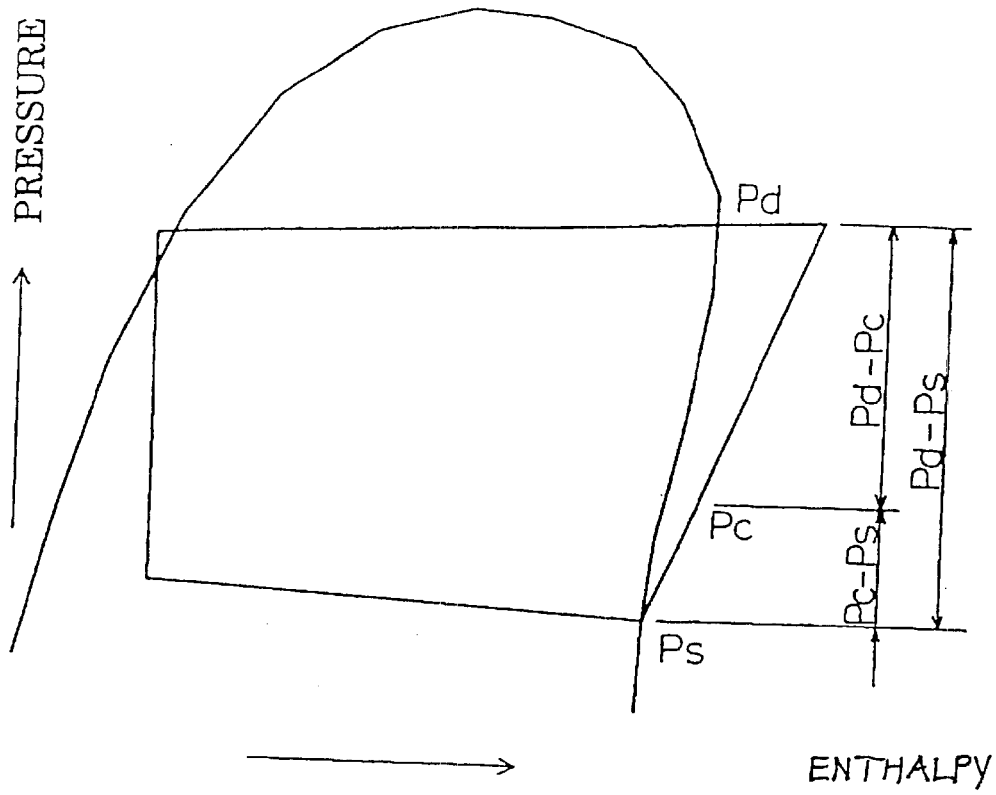

The portion of volume control valve 20 (fifth embodiment) in FIG. 5 which is executing the volume control is similar to that of the fourth embodiment. In addition a pressure sensitive opening/closing valve 50 is provided in suction pipe 1 upstream of suction chamber 3. Said valve 50 can be opened or closed by a pilot valve provided within volume control valve 20. Said pilot valve has an auxiliary valve body 31 which operates in conjunction with the motions of valve body 25 and is co-acting with a separate valve seat provided in a front end chamber of the body of control valve 20. Said chamber is connected via a pilot line with the pressure sensitive pilot portion of valve 50. As soon as valve body 25 is in an open position, said pilot valve body 31 achieves a closing position, and vice versa. The pilot pressure for valve 50 is derived from pressure Pd.

Said opening/closing valve 50 is set to be closed as soon as the current for electromagnetic coil 21 is cut off. This prevents low-pressure refrigerant in suction pipe 1 from entering the compressor 10 during a minimal operation state, e.g. an operation with only 5% of the maximum capacity. The interference of said valve 50 prevents that fins of the evaporator will be frozen at the minimum operation state of the compressor and when the cooling load is low as e.g. in wintertime.

The invention is not limited to the described embodiments. The specific structure of the electromagnetic control valve 20 may be designed with various modifications. The pressure which is used to form the differential pressure with the discharge pressure Pd even may be a mixture of the crank chamber pressure Pc and the suction pressure Ps. The invention can be employed to volume control apparatuses of rotary type or scroll type variable displacement compressors as well.

What is claimed is:

1. A compression volume control apparatus for a refrigeration cycle, comprising:

a variable displacement refrigerant compressor having a suction chamber;

a low-pressure refrigerant pipe connected to the variable displacement refrigerant compressor;

a high-pressure refrigerant pipe;

a refrigerant discharge chamber connected to the high-pressure refrigerant pipe;

a pressure adjusting chamber; and an electromagnetic control valve operating by electromagnetic force coupled in flow connection between the pressure adjusting chamber and at least one of the refrigerant discharge chamber and the suction chamber, wherein the refrigerant discharge volume is variable by varying a pressure in the pressure adjusting chamber, wherein the electromagnetic control valve controls a differential pressure between at least one of a pressure in the pressure adjusting chamber and a pressure in the suction chamber at one side of the electromagnetic control valve and the electromagnetic control valve controls a pressure in the discharge chamber at another side of the electromagnetic control valve to a predetermined differential pressure value to control a refrigerant discharge volume, and wherein the differential pressure value is variable by varying the electromagnetic force of the electromagnetic control valve.

2. A compression volume control apparatus for a refrigeration cycle, comprising:

a variable displacement refrigerant compressor having a suction chamber;

a low-pressure refrigerant pipe connected to the variable displacement refrigerant compressor;

a high-pressure refrigerant pipe;

a refrigerant discharge chamber connected to the high-pressure refrigerant pipe;

a pressure adjusting chamber; and an electromagnetic control valve including a valve body loaded by electromagnetic force towards a valve seat provided in flow connection between separated passages connected to regions having differing pressure states, wherein the refrigerant discharge volume is variable by varying a pressure in the pressure adjusting chamber, wherein the valve body co-acts with the valve seat to maintain a predetermined differential pressure at a substantially predetermined differential pressure value in proportion to the electromagnetic force, wherein the predetermined differential pressure value is variable by varying the electromagnetic force of the electromagnetic control valve, wherein the valve seat is provided between a passage connected to the pressure adjusting chamber and a passage connected to the discharge chamber, and wherein the valve body is facing the valve seat from the side of the passage connected to the pressure adjusting chamber and the electromagnetic force loads the valve body in a closing direction towards the valve seat and counter to a pressure in the passage connected to the discharge chamber.

3. The compression volume control apparatus according to claim 2, further comprising a leakage path provided between the passage connected to the pressure adjusting chamber and a suction chamber line.

4. The compression volume control apparatus according to claim 2, wherein a pressure at the passage connected to the discharge chamber loads the valve body in an opening direction counter to the electromagnetic force.

5. The compression volume control apparatus according to claim 2, further comprising: front and rear spaces adjacent to the valve seat connected to the passages connected to the discharge chamber and the pressure adjusting chamber, wherein the valve body performs opening and closing operations by a differential pressure between the pressure in the discharge chamber and pressure in the pressure adjusting chamber by opening and closing flow connection between the pressure adjusting chamber and the discharge chamber.

6. The compression volume control apparatus according to claim 2, wherein the pressure at the passage loads the valve body in an opening direction and counter to the electromagnetic force so that the pressure at the passage is balance on the valve body and so that a leakage path is provided inside the electromagnetic control valve between the passage and a further passage connected to the suction chamber, wherein the further passage is provided within the electromagnetic control valve at a side of the passage opposite to the passage, and wherein the pressure of the passage loads the valve body in a closing direction.

7. The compression volume control apparatus according to claim 2, further comprising:

a piston rod provided at a rear side of the compression volume control apparatus;

an aperture defining a passage connected to the suction chamber facing a rear pressure receiving side of the piston rod;

an aperture defining a passage connected to the pressure adjusting chamber facing a side surface of the piston rod configured to cancel pressure of the pressure adjusting chamber to act axially on the piston rod; and an aperture defining a passage connected to the discharge chamber provided at a rear side of the valve seat as viewed from the valve body side, wherein the valve body performs opening and closing operations by differential pressure between the pressure in the discharge chamber and pressure in the suction chamber by opening and closing flow connection between the pressure adjusting chamber and the discharge chamber.

8. A compression volume control apparatus for a refrigeration cycle, comprising:

a variable displacement refrigerant compressor having a suction chamber;

a low-pressure refrigerant pipe connected to the variable displacement refrigerant compressor;

a high-pressure refrigerant pipe;

a refrigerant discharge chamber connected to the high-pressure refrigerant pipe;

a pressure adjusting chamber; and an electromagnetic control valve including a valve body loaded by electromagnetic force towards a valve seat provided in flow connection between separated passages connected to regions having differing pressure states, wherein the refrigerant discharge volume is variable by varying a pressure in the pressure adjusting chamber, wherein the valve body co-acts with the valve seat to maintain a predetermined differential pressure at a substantially predetermined differential pressure value in proportion to the electromagnetic force, wherein the predetermined differential pressure value is variable by varying the electromagnetic force of the electromagnetic control valve, wherein the valve seat is provided between a passage connected to the pressure adjusting chamber and a passage connected to the suction chamber, wherein the valve body is facing the valve seat at a side of the passage connected to the suction chamber, wherein the valve body has an axial piston rod extending from the passage connected to the suction chamber into a further separate passage connected to the discharge chamber, wherein a suction chamber pressure is balanced at the valve body and piston rod, wherein a pressure at the passage connected to the pressure adjusting chamber and the electromagnetic force load the valve body in a closing direction towards the valve seat, and wherein a pressure at the passage connected to the discharge chamber loads the valve body in an opening direction.

9. The compression volume control apparatus according to claim 8, wherein the piston rod is provided integral with the valve body at a rear side thereof, wherein a space defining a passage connected to the discharge chamber is facing a rear pressure receiving side of the piston rod, wherein a space defining the passage connected to the suction chamber faces a side surface of the piston rod to cancel the pressure in the suction chamber and to axially act on the piston rod and the valve body, wherein a space defining the passage connected to the pressure adjusting chamber is provided at a rear side of the valve seat seen from the valve body side, wherein the valve body performs opening and closing operations by responding to differential pressures between the pressure in the discharge chamber and pressure in the adjusting chamber by opening and closing flow connection between the pressure adjusting chamber and the suction chamber.

10. A compression volume control apparatus for a refrigeration cycle, comprising:

a variable displacement refrigerant compressor having a suction chamber;

a low-pressure refrigerant pipe connected to the variable displacement refrigerant compressor;

a high-pressure refrigerant pipe;

a refrigerant discharge chamber connected to the high-pressure refrigerant pipe;

a pressure adjusting chamber;

a valve seat provided between a passage connected to the pressure adjusting chamber and a separated passage connected to the suction chamber; and an electromagnetic control valve including a valve body loaded by electromagnetic force towards the valve seat provided in flow connection between the separated passages connected to regions having differing pressure states, wherein a refrigerant discharge volume is variable by varying pressure in the pressure adjusting chamber, wherein the valve body co-acts with the valve seat to maintain a predetermined differential pressure at a substantially predetermined differential pressure value in proportion to the electromagnetic force, wherein the predetermined differential pressure value is variable by varying the electromagnetic force of the electromagnetic control valve, wherein the valve body faces the valve seat at the side of the separated passages, wherein the valve body has an axial piston rod extending from the passage connected to the pressure adjusting chamber into a further separated passage connected to the discharge chamber, wherein pressure at the passage connected to the crank chamber is pressure balanced at the valve body and the piston rod, wherein the pressure at the passage connected to the suction chamber and electromagnetic force both load the valve body in a closing direction towards the valve seat, and wherein the pressure at the passage connected to the discharge chamber loads the valve body in an opening direction.

11. The compression volume control apparatus according to claim 10, further comprising a leakage path provided between the passages.

12. The compression volume control apparatus according to claim 10, further comprising:

a piston rod integral with the valve body at a rear side of the valve body;

an aperture defining a passage connected to the discharge chamber facing a rear pressure receiving side of the piston rod; and an aperture defining the passage connected to the pressure adjusting chamber facing a side surface of the piston rod to cancel pressure of the pressure adjusting chamber to axially act on the piston rod and the valve body such that the valve body performs opening and closing operations by response to a differential pressure between the pressure in the discharge chamber and the pressure in the suction chamber and opens and closes flow connection between the pressure adjusting chamber and the suction chamber.

13. The compression volume control apparatus according to claim 10, further comprising:

an opening and closing valve provided at an upstream side of the suction chamber within the low-pressure refrigerant pipe; and an auxiliary pilot valve consisting of a valve body driven by the electromagnetic control valve and valve seat, the auxiliary pilot valve being provided within the electromagnetic control valve for opening and closing the opening and closing valve.

14. The compression volume control apparatus according to claim 10, wherein the pressure adjusting chamber is an airtight crank chamber of the compressor containing an oscillating body provided in the crank chamber to change an inclination angle of the crank chamber with respect to a rotary shaft for carrying out an oscillating motion when driven by a rotational motion of the rotary shaft, and wherein pistons are coupled to the oscillating body for reciprocation within cylinders to compress refrigerant received from the suction chamber and to discharge compressed refrigerant to the discharge chamber.

* * * * *